US007293736B2

(12) United States Patent
Recami et al.

(10) Patent No.: US 7,293,736 B2
(45) Date of Patent: Nov. 13, 2007

(54) REWINDING MACHINE TO REWIND WEB MATERIAL ON A CORE FOR ROLLS AND CORRESPONDING METHOD OF WINDING

(75) Inventors: Alberto Recami, Firenze (IT); Giuliano Pagliani, Santa Agata Mugello (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 10/466,422

(22) PCT Filed: Jan. 16, 2001

(86) PCT No.: PCT/IB01/00035

§ 371 (c)(1),
(2), (4) Date: Dec. 10, 2003

(87) PCT Pub. No.: WO02/055420

PCT Pub. Date: Jul. 18, 2002

(65) Prior Publication Data

US 2004/0099761 A1 May 27, 2004

(51) Int. Cl.
*B65H 18/14* (2006.01)

(52) U.S. Cl. ..... 242/542.1; 242/542.2; 242/533.1

(58) Field of Classification Search ..... 242/521, 242/542.1, 542.2, 533, 533.1
See application file for complete search history.

(56) References Cited

U.S. PATENT DOCUMENTS

| | | | | | |
|---|---|---|---|---|---|
| 2,989,262 | A * | 6/1961 | Hornbostel | ..... | 242/523.1 |
| 3,610,545 | A * | 10/1971 | Reifenhauser et al. | ... | 242/527.3 |
| 3,791,603 | A | 2/1974 | Lenius | | |
| 4,583,698 | A * | 4/1986 | Nistri et al. | ..... | 242/524 |
| 4,723,724 | A * | 2/1988 | Bradley | ..... | 242/521 |
| 4,962,897 | A * | 10/1990 | Bradley | ..... | 242/521 |
| 4,988,051 | A | 1/1991 | Welschlau et al. | | |
| 5,137,225 | A * | 8/1992 | Biagiotti | ..... | 242/521 |
| 5,368,252 | A * | 11/1994 | Biagiotti | ..... | 242/521 |
| 5,439,187 | A | 8/1995 | Shimizu | | |
| 5,639,045 | A | 6/1997 | Dorfel | | |
| 6,116,669 | A * | 9/2000 | Scaglia | ..... | 294/67.22 |
| 6,729,572 | B2 * | 5/2004 | Baggot et al. | ..... | 242/532.2 |
| 2003/0080234 | A1 | 5/2003 | Baggot et al. | | |

FOREIGN PATENT DOCUMENTS

| | | |
|---|---|---|
| CH | 476 620 A | 8/1969 |
| DE | 476 620 A | 8/1969 |
| DE | 3635197 C1 | 2/1988 |
| EP | 0 524 158 A1 | 1/1993 |
| EP | 0 747 308 B1 | 12/1996 |
| EP | 0 778 235 B1 | 6/1997 |
| EP | 0 959 032 | 11/1999 |
| EP | 0 962 411 B1 | 12/1999 |
| GB | 779101 | 8/1957 |
| GB | 1106704 | 3/1968 |
| GB | 1190850 | 6/1970 |

* cited by examiner

*Primary Examiner*—Peter M. Cuomo
*Assistant Examiner*—Sang Kim
(74) *Attorney, Agent, or Firm*—Hogan & Hartson LLP

(57) ABSTRACT

In a rewinding machine for winding web material onto a core to form rolls which has an unusual capability for accurate regulation of the winding, the web material is supplied to a winding drum and is transferred to the core to form the roll. The core is supported, rotated in controlled manner, and transported along a path in which the roll of web material wound on the core is enlarged whilse bearing continuously on the winding drum.

61 Claims, 10 Drawing Sheets

REWINDING MACHINE TO REWIND WEB MATERIAL ON A CORE FOR ROLLS AND CORRESPONDING METHOD OF WINDING

BACKGROUND OF THE INVENTION

The subject of the present invention is a rewinding machine for winding material in web form onto a core to form rolls, as well as a corresponding winding method.

It is known that the winding of rolls of web material onto cores such as, for example, the winding of paper tissue onto cardboard cores, is performed by means of plant comprising apparatus for continuously unwinding paper from a reel. Downstream of this apparatus there is a winder or rewinding machine which winds the paper onto a plurality of cores to form the rolls. Downstream of the rewinding machine in turn there is apparatus for cutting the finished roll into a plurality of small rolls.

In particular, two methods are known for winding the web material onto the core.

In a first method, known as central winding, the core is fitted on a motor-driven spindle of the same length as the core, for rotating the core about its axis. When an edge of the web material has been stuck to the core, the desired quantity of web material is wound onto the core by rotation of the spindle, to form the roll. Upon completion of the winding, the roll is removed from the working area and the spindle is taken out of the core and returned to the working area by a recirculating device.

A machine of the type described above is known from U.S. Pat. No. 5,660,350.

Although these machines have considerable advantages, they have the disadvantage that it is necessary to use spindles and cores of limited axial length. In fact, during the roll-forming step, long cores fitted on long spindles would clearly be subject to bending forces which would set up vibrations such that accurate and even winding with uniform compactness throughout the winding operation would be impossible, resulting in an irreparable deterioration in the quality of the product.

A second method also used for winding web material onto cores is known as peripheral winding. According to this method, after the core has been brought up to winding drums so as to cause the web material to adhere to the core, the core is driven by the drums in a winding area in which the roll being formed is acted on peripherally by three drums, leaving the core free to float in the web material which is being wound thereon.

A machine of the type described above is known from WO 99/42393 in which, upon completion of the winding, the core is removed from the wound roll, to form rolls without support cores.

However, it is clear that, although this latter solution is simpler in operation, it has many disadvantages.

First of all, peripheral winding, by its nature, does not allow the rate of rotation of the core to be controlled directly since the core is floating in the winding area between the three winding drums. With these known rewinding machines, it is therefore impossible to control the tension of the web material directly during its winding around the core, making it particularly difficult to produce rolls which have a uniform consistency throughout their thickness. This disadvantage is particularly important above all when a particularly soft roll is to be produced, as is required by some markets such as, for example, the United States market. In particular, if the web material is supplied without considerable pretensioning, it is almost impossible to ensure the same compactness of the roll both in the initial stages of the winding and in the final stages of the winding and, in the case of particularly soft rolls, the core may even be eccentric relative to the axis of the roll upon completion of the winding.

SUMMARY OF THE INVENTION

The problem upon which the present invention is based is that of proposing a rewinding machine for winding web material onto a core to form rolls which has structural and functional characteristics such as to overcome the disadvantages mentioned above with reference to the prior art cited.

This problem is solved by a rewinding machine for winding web material onto a core to form rolls according to claim 1.

In the rewinding machine proposed, the web material is supplied to a winding drum and the web material is transferred to the core to form the roll.

The core is advantageously supported, rotated in controlled manner, and transported along a path in which the roll of web material wound on the core grows larger whilst continuously bearing on the winding drum.

The problem is also solved by a method of winding web material onto a core to form rolls according to claim 50.

Advantageously, in the proposed method, the web material is supplied at a predefined supply speed, the web material is guided, in a winding region, at a speed substantially corresponding to the supply speed, and the core is supported and is rotated in a manner such as to have a predefined peripheral velocity. The core is moved along a working path formed between a pick-up position and a release position, passing from a position of initial contact of the core with the web material, in order to pick up the web material, and continuing towards a final winding position, through a size-enlargement or increasing portion in which the material is wound on the core to form the roll. The core is thus influenced in a manner such that the material is wound onto the core whilst the roll being formed is kept bearing against the winding drum throughout the increasing portion of the working path.

BRIEF DESCRIPTION OF THE DRAWINGS

Further characteristics and the advantages of the rewinding machine according to the invention will become clear from the following description of a preferred embodiment thereof, given by way of non-limiting example with reference to the appended drawings, in which.

DESCRIPTION OF THE PREFERRED EMBODIMENTS

Figure 2A:
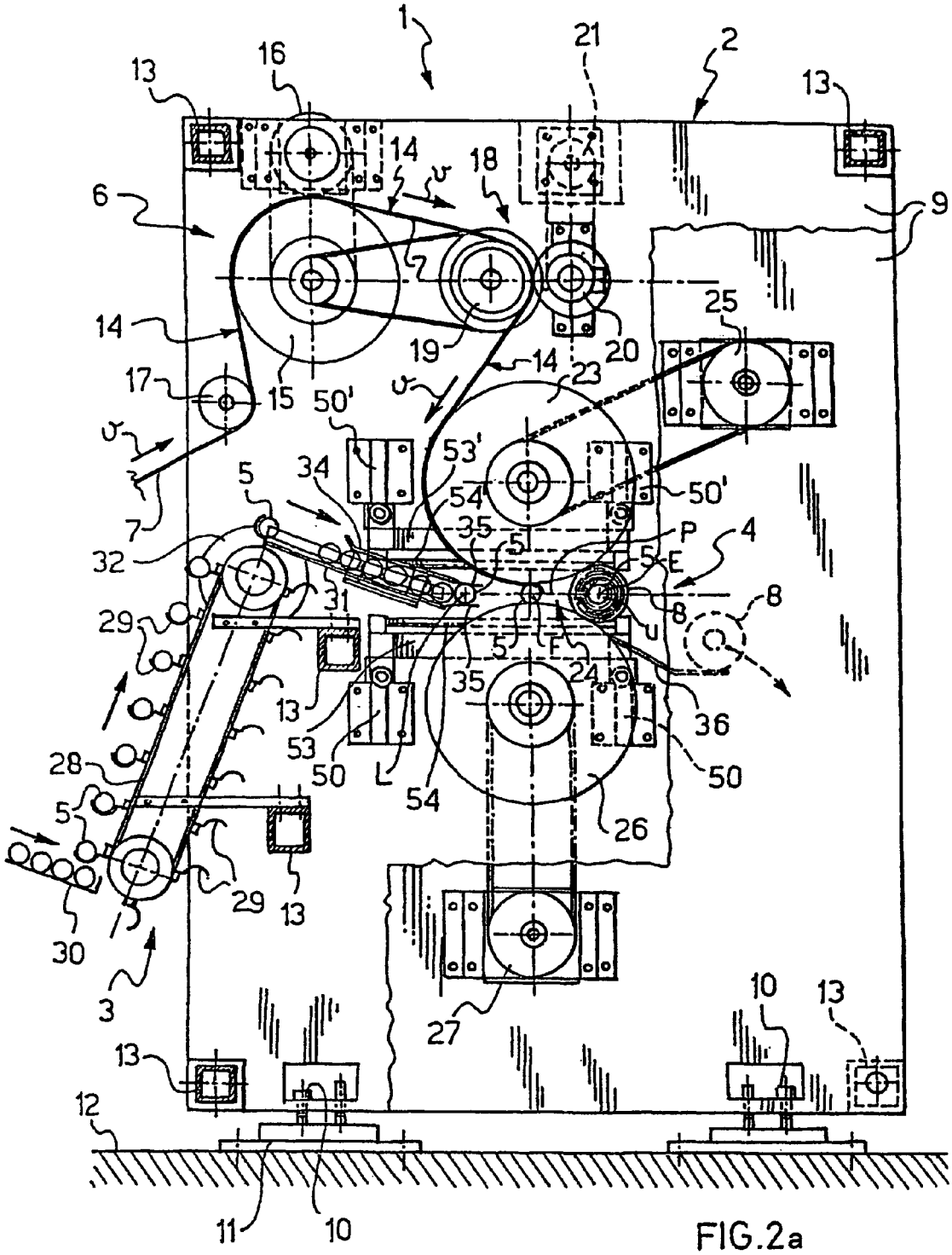
FIG. 2*a* is a partially-sectioned view of the rewinding machine, taken on the arrow II of FIG. 1.

With reference to the drawings, a rewinding machine, generally indicated 1, comprises a support frame 2, a supply device 3 for supplying cores 5 to a winding assembly 4, as well as means 6 for supplying web material 7 to be wound onto the cores to form rolls 8 (FIG. 2*a*).

Figure 1:
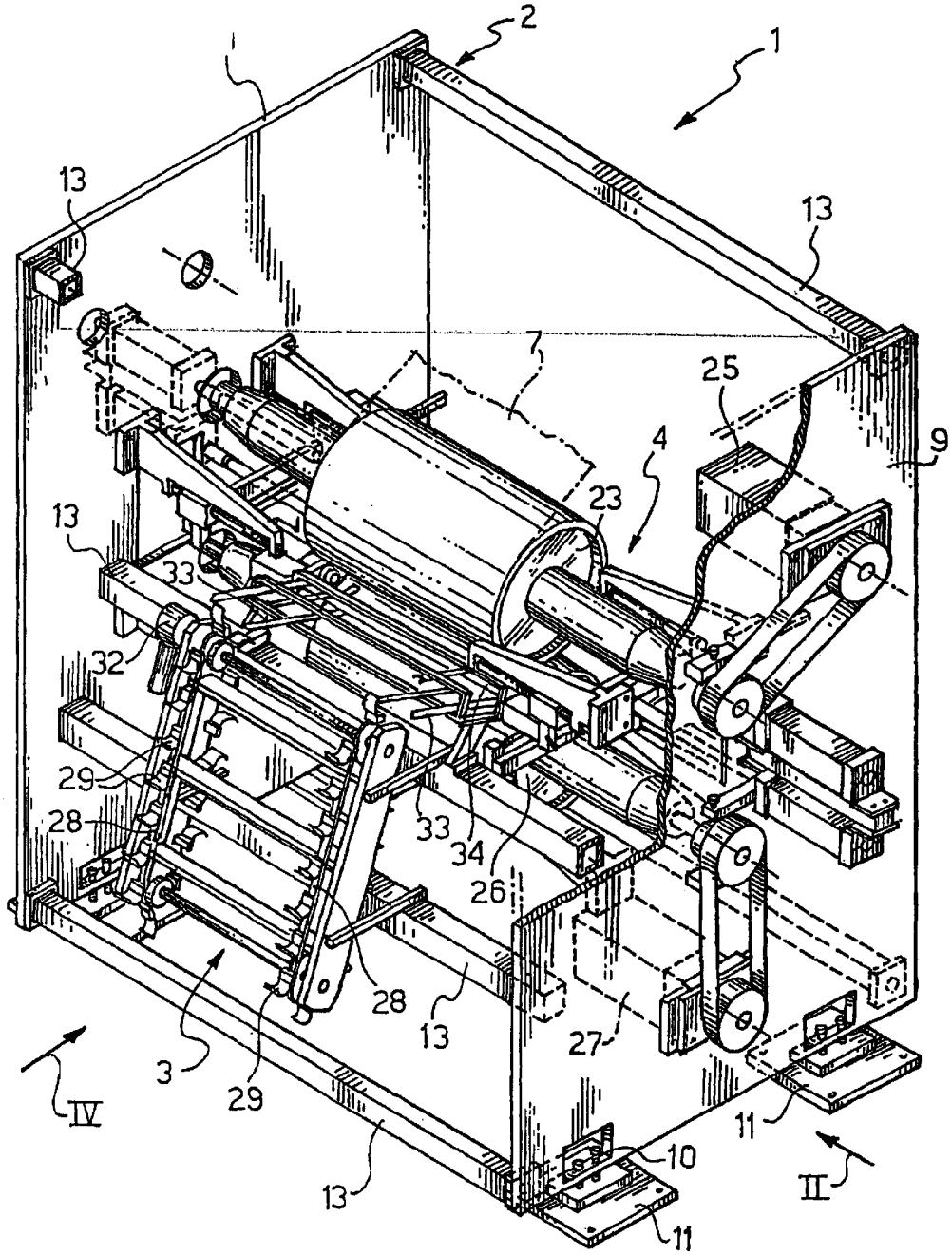
FIG. 1 is a partially-sectioned axonometric view of a rewinding machine.
Figure 2B:
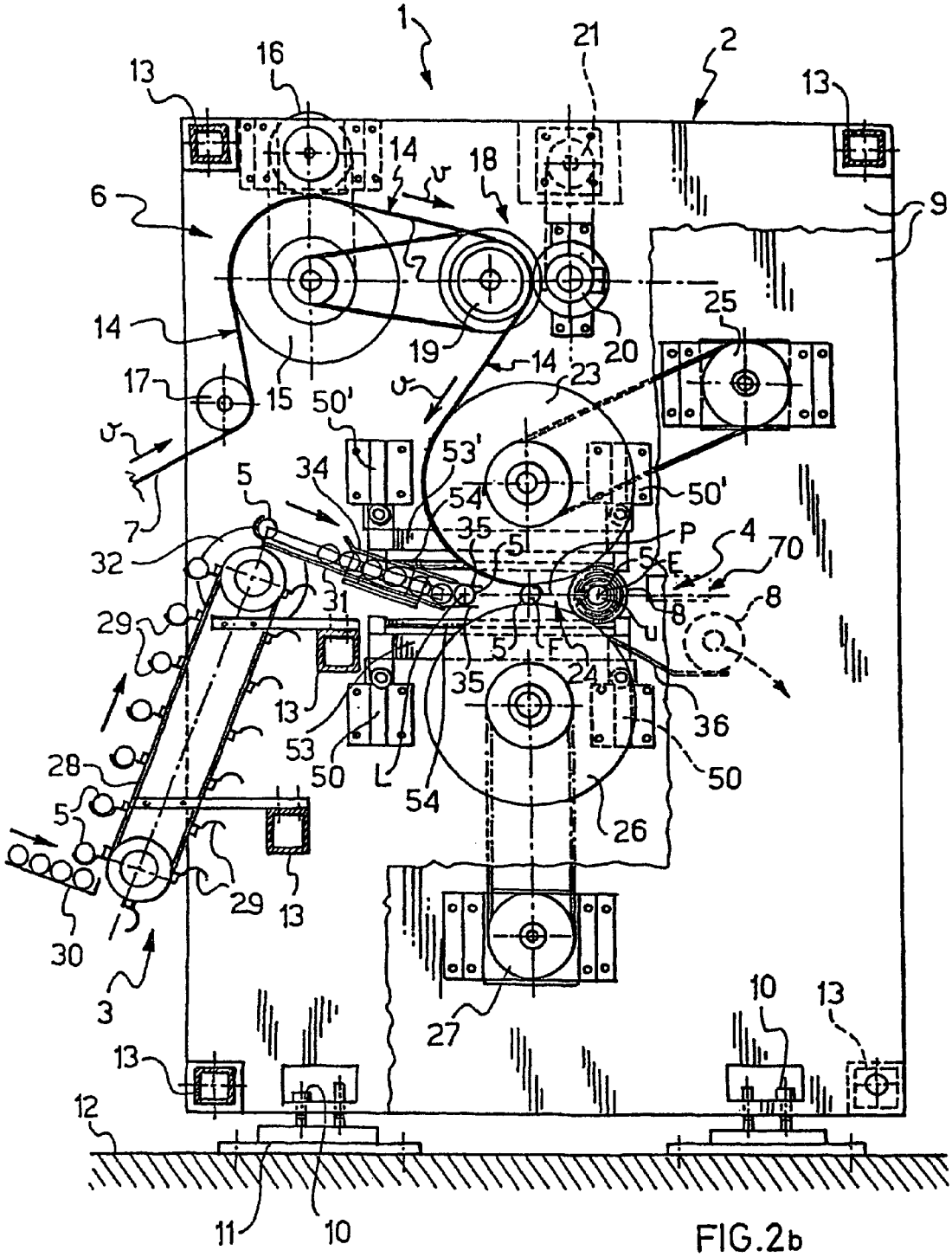
FIG. 2*b* is a partially-sectioned view of the rewinding machine according to an embodiment of the present invention.

The support frame 2 comprises opposed shoulders 9 connected by self-leveling bolts 10 to support plates 11 fixed to a base 12. The shoulders 9 are connected to one another by a plurality of cross-members 13 constituting support elements for further components of the machine. According to one embodiment, the cross-members 13 are tubular profiled sections, for example, having square cross-sections to provide secure support surfaces for the further components of the machine. The support frame 2 defines a machine space which is open on three of its sides for the operative connection of the machine to a web-material plant (FIGS. 1 and 2*b*).

The web material 7 coming from apparatus for unwinding it continuously from at least one reel or "mother reel" (not shown) is supplied to the machine 1. For example, the web material 7 comprises one or a plurality of webs of paper, particularly tissue, which, once unwound from one or more reels, may undergo known intermediate printing and/or embossing treatments before being supplied to the rewinding machine 1. According to one embodiment, the web material follows a supply path 14 defined by a plurality of drums arranged parallel to one another and supported rotatably on the shoulders 9 of the support frame 2. The supply means 6 move the web material 7 along the supply path 14 at a predefined supply speed. The supply means 6 comprise at least one pulling drum 15 which transmits the movement to the web material which extends partially around it. The pulling drum is operatively connected to an electric motor 16, for example, a "brushless" motor supported on a shoulder 9 and connected by a belt, preferably a toothed belt, to a pulley fitted on one end of the pulling drum 15. Upstream of the pulling drum 15 there is a roller 17 which, as well as obliging the web material to follow a tortuous path to force it to extend around an upper portion of the surface of the pulling drum 15, has a transducer, for example, a load cell, operatively connected to the roller 17, for detecting the tension imposed on the web material by the pulling drum. The motor of the pulling drum is operated and controlled in the manner which will be described in detail below.

Parallel to the pulling drum is a unit 18 for pre-cutting the web material 7.

The web material 7, pulled by the supply means 6, is supplied to the winding assembly 4. This comprises a winding drum 23 which guides the material 7 in a winding region 24, defining a first side thereof. The winding drum is supported so as to be freely rotatable on the shoulders 9 of the frame 2 in order to be driven by means of an operative connection to an electric motor 25, so as to have a peripheral velocity substantially corresponding to the speed of supply (v) of the web material 7. For example, a brushless motor supported on one of the shoulders 9 of the support frame 2 is connected by a belt, preferably a toothed belt, to a pulley keyed to one end of the winding drum 23. According to a further embodiment, a second winding drum 26 is provided, opposite the first winding drum 23 and arranged so as to define the region 24 for the winding of the web material on the opposite side to the first winding drum. According to yet another embodiment, the first and second winding drums 23 and 26 are arranged in a manner such that a distance or space of dimensions substantially equal to the transverse dimensions of a core 5 is left between their cylindrical surfaces. The second winding drum 26 is also preferably supported so as to be freely rotatable on the shoulders 9 of the support frame 2 and is operatively connected to an electric motor 27 for rotating it at a speed substantially corresponding to the speed of supply (v) of the web material 7. As for the first drum, the motor of the second drum is, for example, a brushless motor supported on one of the shoulders 9 of the support frame 2 so as to be connected by means of a belt, preferably a toothed belt, to a pulley keyed to an end of the second winding drum 26. The motors of the winding drums are also operated and controlled in the manner which will be described in detail below.

Beside the first and second winding drums 23, 26 and on the side from which the web material 7 is supplied, is the device 3 for supplying cores, for example, tubular cardboard cores 5. This device comprises a pair of conveyor belts 28 each provided with a plurality of support scoops 29 for housing and firmly supporting respective ends of cores 5. The conveyor belts 28 are arranged parallel to one another and in a manner such as to pick up cores 5 from a store 30 in order to lift them and to discharge them into a core-supply chute 31. For its movement, the core-supply device 3 comprises a geared motor unit 32 keyed to a shaft provided with pulleys for housing the conveyor belts in order to move them synchronously. According to one embodiment, the geared motor unit 32 is operatively connected to an actuator activated by a transducer for detecting a lack of cores 5 in the supply chute 31, such as, for example, a photocell which is disposed at a predetermined height on the chute and can detect the presence of the desired number of cores 5 on the chute 31. In particular, the chute comprises plates 33 provided with surfaces for the sliding of the cores, these surfaces extending to the vicinity of the space provided between the two winding drums 23, 26. A cage 34 is associated with the chute plates 33 for preventing superposition of the cores which are urged towards the end close to the drums by gravity. Flat springs 35 projecting from the chute plates 33 at the bottom and from the cage 34 at the top can restrain a core 5 in a pick-up position "L" in the vicinity of the winding region 24.

A working path "P" for the core is formed, starting from the pick-up position and extending between the two winding drums. In the embodiment shown in FIG. 2*a*, the working path "P" is straight. However, the path may adopt different shapes provided that, starting from the pick-up position "1", it extends from a position of initial contact of the core with the web material, indicated "F" in FIG. 2*a*, through a final winding position "E", terminating in a release position "U". For convenience of description ,the working path "P" is divided into an approach portion disposed between the pick-up position "L" and the initial contact position "F", a size-enlargement or increasing portion disposed between the initial contact position "F" and the final winding position "E", and an expulsion portion disposed between the final winding position "E" and the release position "U".

The core 5 is advantageously moved along the working path by virtue of the provision of gripping means for supporting it, means for moving it along the working path, means for its controlled rotation so as to wind the web material onto the core to form the roll, as well as means for influencing the roll as it bears continuously on at least one of the winding drums in the increasing portion of the working path in which the web material is wound onto the core. These latter means preferably influence the roll being formed as it bears continuously on the two winding drums which define the winding region on two sides. The core is then brought to the release position "U" where release means allow the roll 8 to fall onto a discharge chute 36 so as to be conveyed to subsequent known stations for gluing, cutting into small rolls and packaging.

Figure 3A:
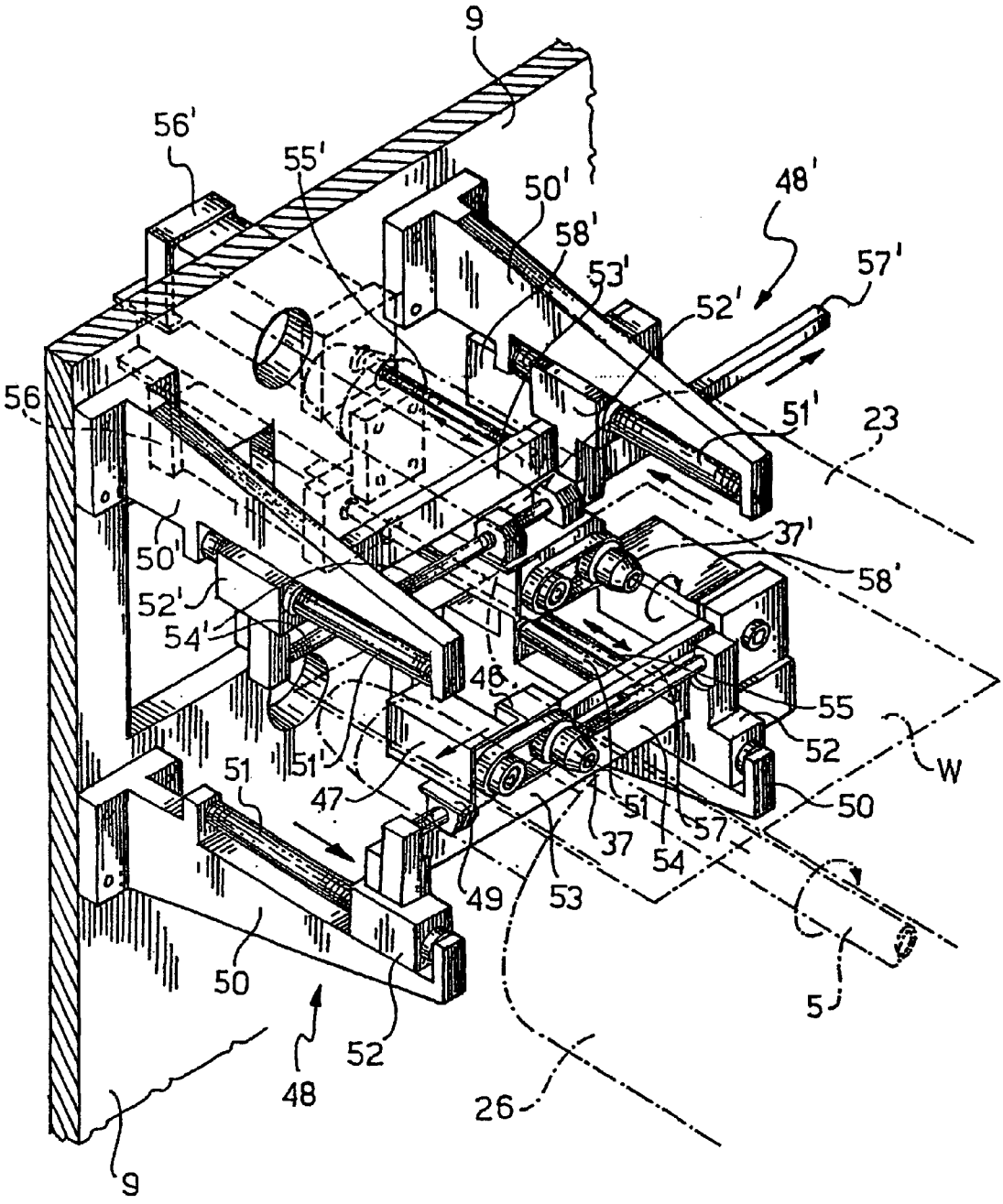
FIG. 3*a* is an axonometric view of a detail of the machine of FIG. 1.
Figure 3B:
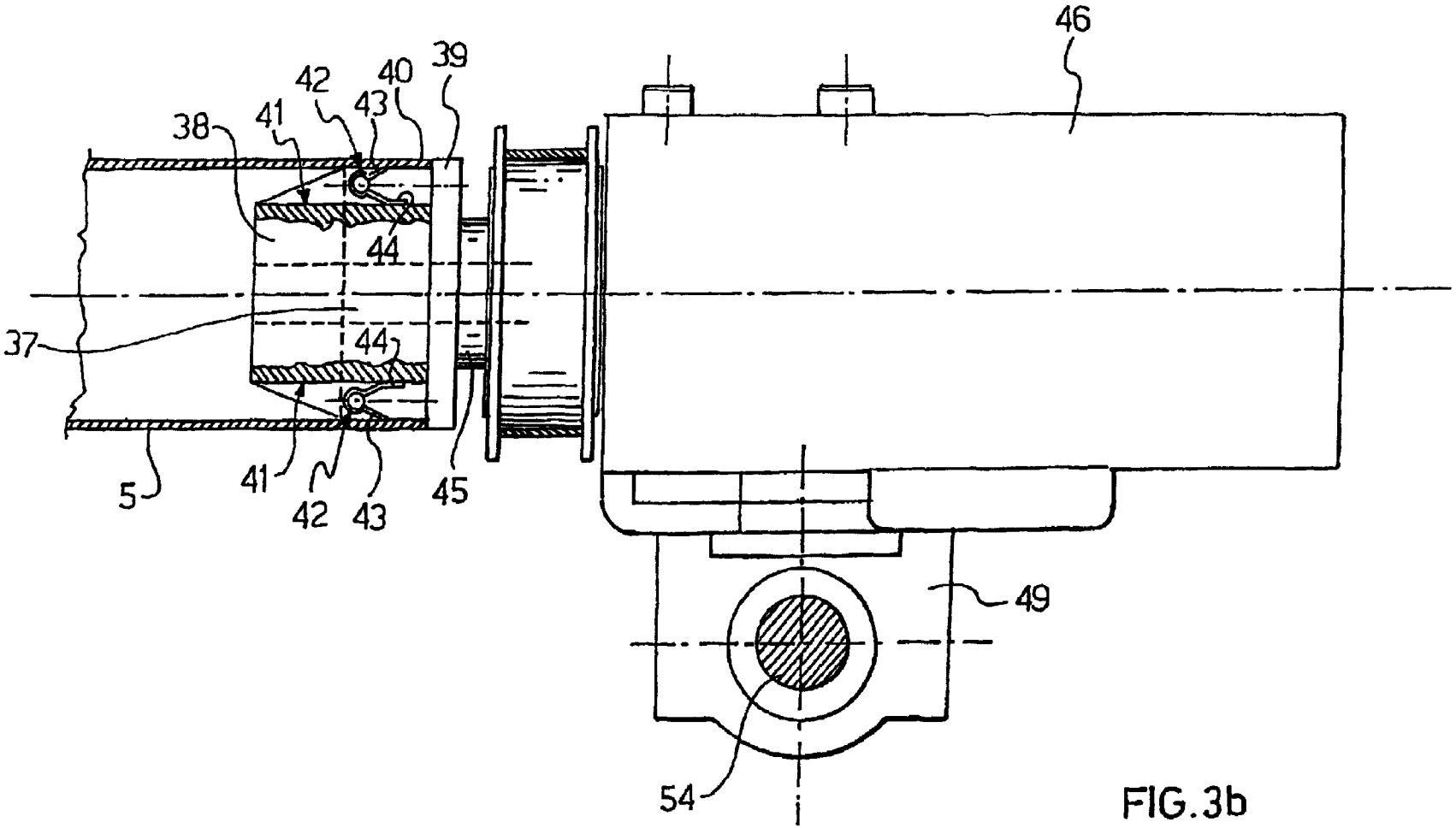
FIG. 3*b* is a partially-sectioned side view of a further detail of the detail of FIGS. 3*a*, 3*c* is an axonometric view of the rewinding machine according to an embodiment of the present invention.

According to one embodiment, at least one pair of opposed pins 37, which can be operatively associated with the insides of the ends of the tubular core 5, is associated with each side of the set of winding drums 23, 26 or, in other words, is associated with the ends of the core 5 in any position thereof on the working path "P". Each pin 37 has a cylindrical body on which the end of a core 5 can be fitted with interference. The body of the pin 37 has a frustoconical free end 38 for facilitating the insertion of the pin 37 in the end of the core 5 and an annular projection 39 for the abutment of the edge 40 of the core 5. At least one longitudinal channel 41 and preferably two opposed channels or several uniformly spaced channels, are formed in the cylindrical body and house retaining means for engaging the inner surface of the wall of the tubular core to ensure a firm grip of the pin even during its movement. According to one embodiment, the retaining means comprise at least one resilient expansion device 42 for gripping the inner surface of the tubular core radially with pressure. According to a further embodiment, the device has at least one blade-like element 43 acting to oppose slipping of the pin out of the tubular body of the core. For example, the device is a spring 42, the body of which is wrapped around a support pin fixed to the wall of the channel 41 so as to allow a first end arm 44 of the spring, provided with a bearing portion, to abut the base of the channel 41, leaving a second arm 43, provided with a blade-shaped end, projecting partially resiliently outwardly relative to the pin and facing towards the annular projection 39 thereof. The pin 37 is arranged on the free end of a shaft 45 housed so as to be freely rotatable in a support 46. Transducers are advantageously operatively associated with the shaft 45 for detecting the forces transmitted by the pin 37 to the core 5 and, in particular, the axial pulling force on the core 5 and the effect of the transmission torque, for example, by detecting the rate of rotation imposed on the core by the pin. A pulley is keyed to the shaft 45 of each pin for operative connection to an electric motor 47 operated and controlled in the manner which will be described in detail below, so as to rotate the core at a predefined speed (FIGS. 3*a* and 3*b*).

According to one embodiment, independent means are provided for the controlled rotation of each end of the core 5.

The at least one pair of opposed pins 37 is moved towards and away from the opposite ends of the core as well as along the working path "P". Preferably, an operative connection is provided between the means for gripping the core 5 and the means for moving the core 5.

According to one embodiment, each of the gripping means is operatively connected to a table with crossed guides (for example a compound table), generally indicated 48 in the drawings. In particular, the means for moving the core comprise opposed carriages 49 provided on both sides of the machine 1 for supporting the gripping means comprising the pin 37 and the respective motor 47 for rotating the pin. The carriages 49 are movable in controlled manner along movement axes arranged, for example, parallel and perpendicular to the working path "P". According to one embodiment, the movement axes comprise, for each side of the rewinding machine 1, a pair of brackets 50 which are cantilevered on the shoulders 9 of the support frame and on which guides 51 are arranged parallel to one another and perpendicular to the working path "P". The transverse guides 51 are spaced apart so that the entire working path "P" is included between them, in the manner which will be explained further below. The transverse guides 51 support, in a freely slidable manner, sliding blocks 52 fixed to a single cross-member 53 on which a guide 54 parallel to the working path "P" is provided. The cross-member 53 is operatively connected to an actuating device for causing it to slide on the transverse guides 51 by means of the sliding blocks 52. According to one embodiment, a rod 55 of a cylinder and piston unit 56 supported firmly on the shoulders 9 of the support frame 2 is connected to the cross-member. For example, the cylinder and piston unit is of the pneumatic or hydraulic type and is operated in controlled manner, in the way which will be described in detail below. The parallel guide 54 supports, in a freely slidable manner, the carriage 49 carrying the pin 37. The carriage 49 is operatively connected to a device for its controlled movement along the guide 54 parallel to the working path "P". According to one embodiment, a rack 57 fixed firmly to the carriage 49 is meshed with a pinion of a geared motor unit 58 supported firmly on one of the sliding blocks 52. The geared motor unit 58 is operatively connected to a operating and control device in the manner which will be described in greater detail below (FIGS. 2*a* and 3*a*).

The guides 51 arranged transverse the path "P" and the guides 54 which are parallel thereto are preferably straight and enable the gripping means to be moved in a working plane "W" (FIG. 3*a*).

Advantageously, in addition to the provision of independent means for moving each end of the core, twin independent movement means are provided for each side of the rewinding machine 1 and can be associated with ends of cores for multiple movements thereof in the same working area, for example, in the working plane "W", in the manner which will be described in detail below. For example, identical movement means are provided for each side of the rewinding machine and are arranged reflectively symmetrically with respect to the working plane "W" of movement of the gripping means. These reflectively symmetrical movement means have corresponding elements which are indicated in the drawings by the same reference numerals provided with apostrophes "'". Twin independent gripping means, controlled rotation means, movement means, and means for influencing the core 5 bearing on the winding drum 23 will thus be provided for each side or side wall of the rewinding machine.

With regard to the movement of the pair of opposed pins 37, 37' towards and away from the core 5, the means for the movement of the core comprise further means for pulling the core 5 axially during the winding of the web material. According to one embodiment, this function is performed by the cross-member 53, 53' slidable on the transverse guides 51, 51', and moved by the cylinder and piston unit 56, 56'.

Figure 8:
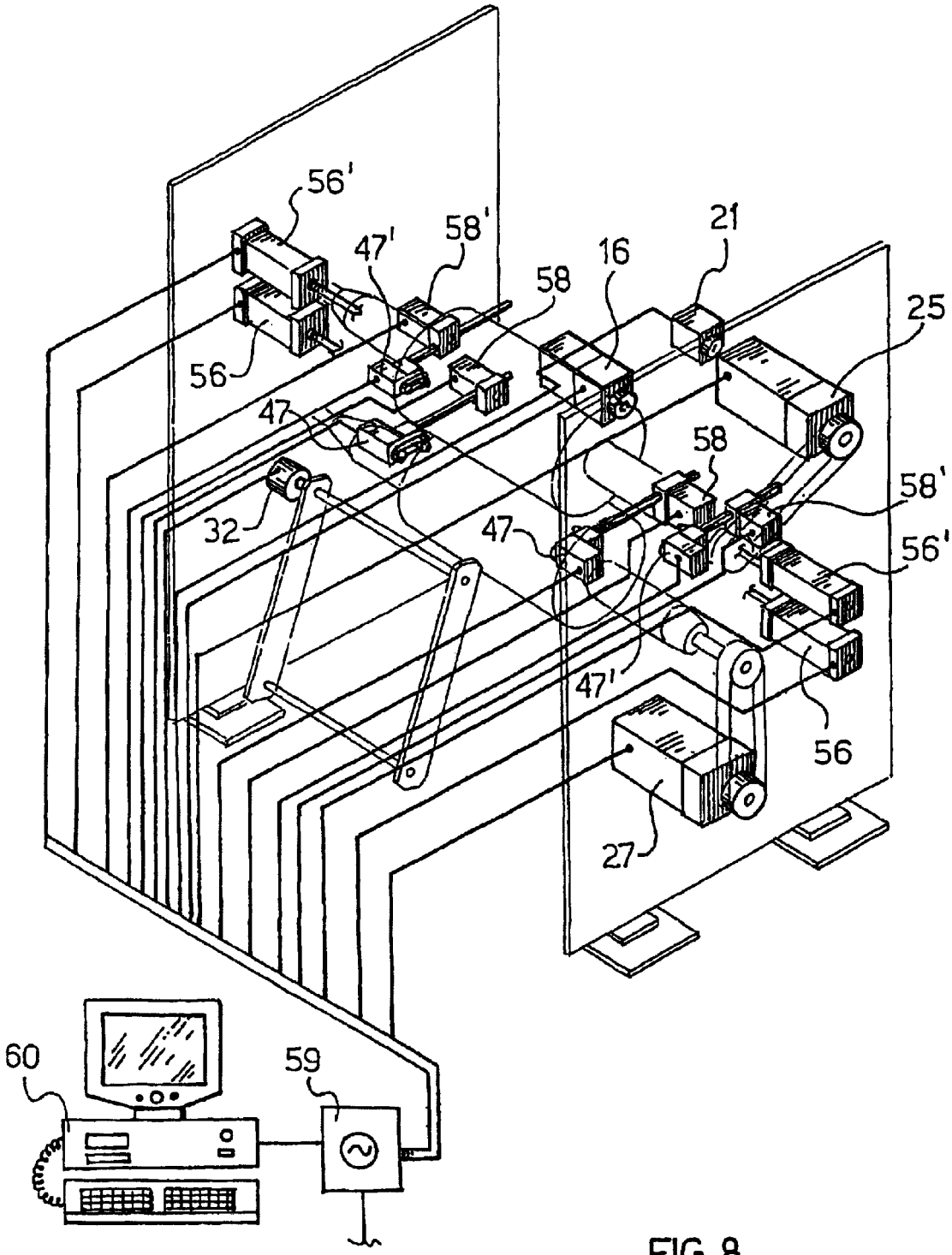
FIG. 8*a* is a schematic perspective view of the operating and control system of the rewinding machine of FIG. 1.
FIG. 8*b* is a schematic perspective view of the operating and control system of the rewinding machine, according to an embodiment of the present invention.

Each of the above-mentioned devices for moving the drums and the cores is operatively connected to a corresponding operating device which, for convenience of illustration has been indicated by a single reference element, indicated 59 in FIG. 8. These operating devices 59 are controlled by one or more control devices 60, preferably with feedback (FIG. 8). In particular, the motor 16 for rotating the pulling drum 15 is operated in controlled manner, for example, by a signal proportional to the tension exerted on the web material 7, detected by the load cell provided in the roller 17 and fed back to the control device 60. According to one embodiment, the control imposed on the operation of the pulling drum 15 constitutes a reference for the operation, in synchronism or out of phase therewith, of the winding assembly 4 and of the core-supply device 3, as well as of the means for gripping, rotating and moving the core. In particular, the winding drum 23 is operated in controlled manner, advantageously with feedback of its rate of rotation, so as to achieve a peripheral velocity thereof, that is, a speed of its curved surface in contact with the web material, substantially corresponding to, greater than, or less than the speed imposed on the web material 7 by the pulling drum 15 (the supply speed "v"). The second winding drum 26 is also driven in controlled manner with feedback of its rate of rotation so as to achieve a peripheral velocity thereof substantially corresponding to, greater than, or less than the supply speed of the web material 7. By controlled regulation of the relative speeds of the two winding drums 23 and 26, it is possible to regulate the winding of the web material onto the core and consequently the consistency of the roll. With regard to the means for rotating the core 5, there is provision for their controlled operation with speed feedback which, with a knowledge of the thickness of the web material, for example, because it is predefined or is detected by thickness detecting means such as suitable transducers 70, can achieve a peripheral velocity of the roller 8 being wound substantially corresponding to, greater than or less than the supply speed of the web material 7. A controlled enlargement or increase of the roll of web material is thus achieved. With a speed substantially corresponding to the supply speed, a roll with uniform compactness is obtained, with a speed greater than the supply speed, a small, tight and compact roll is obtained, and with a slower speed, a soft and voluminous roll is obtained, respectively. According to one embodiment, a device is interposed between the gripping means and the means for the controlled rotation of the core for detecting the force transmitted to the core. This device for detecting forces transmitted to the core is preferably operatively connected to the device for bringing about and controlling the rotation of the core and the axial pulling of the core. In particular, by virtue of the device which detects the forces transmitted to the core by the means for its rotation, it is possible to detect the occurrence of torsional, and principally flexural, vibrations, during the winding of the web material thereon. The provision of independent means for the controlled rotation of each end of the core advantageously permits a synchronized or out-of-phase movement of the two ends of the core in order to control the axial uniformity of the winding, and to actively damp the vibrations produced in the growing roll.

The device for controlling the rotation of the core is advantageously operatively connected to the device for rotating the pulling drum so as automatically to regulate the uniformity of the compactness of the roll being wound upon variations of the speed of supply of the web material.

With further advantage, each carriage 49, 49' is moved along at least one of the movement axes defined by the guides 51, 54 and 51', 54' in controlled manner. For this reason, as already mentioned, the cylinder and piston units 56, 56' and the geared motor units 58, 58' are operatively connected to the operating devices 59 and to the control devices 60 with speed and/or movement feedback, for example, by means of speed and/or movement transducers connected to the movement devices 56, 56' and 58, 58' and/or to the sliding blocks 52, 52' and to the carriages 49, 49', respectively. By virtue of the controlled operation, advantageously with feedback, it is possible to move the core along the working path "P", controlling its position relative to the winding drums 23, 26 at every moment, and to control the steps of picking up the core from the flat springs 35 (pick-up position "L") and releasing it in the release position "U". The controlled movement of the cylinder and piston units 56, 56' also enables an axial pulling force to be applied to the core 5 gripped by the springs 42 of the pins 37, reducing its bending deformation brought about by its own weight and by the weight of the web material wound on it and reducing or eliminating the vibrations produced by the winding operation. The controlled operation of the means for moving the core 5, advantageously with feedback, also enables the core 5 to be influenced so as to keep the roll 8 being formed continuously bearing against the winding drums 23, 26, ensuring that it is guided securely and supported throughout the increasing portion of the working path "P".

A description of the operation of a rewinding machine according to the present invention is given below.

The web material is drawn into the rewinding machine by the pulling drum, operated in controlled manner and preferably with feedback of the value of the tension imparted to the web material, defining the production rate of the rewinding machine. This rate of operation of the machine is set by the control device, for example, a numerical control device arranged for controlling all of the operations. The tension which is produced in the web material in various portions of its path, as well as its speed are thus influenced by the predefined speed set for the pulling drum.

When the rewinding machine is started, predefined timing rules are imposed on the operation of the pulling drum and, in particular, predefined acceleration rules, for example, depending on the type of web material supplied, so as to enable the nominal speed of the machine to be reached in as short a time as possible whilst maintaining the synchronism of operation of all of the parts making up the machine and ensuring optimal production quality.

The web material moved by the pulling drum is supplied to the pre-cutting unit where the web material is pre-cut transversely at regular intervals, in known manner.

When the pre-cutting has been performed, the web material is supplied to the winding unit where it is guided by the winding drum to the vicinity of the working path "P" in order to be collected by a core in the manner which will be described below. The winding drum is connected electronically to the device for operating and controlling the pulling drum so that the pull on the web material is kept constant and the occurrence of excessive stresses therein which might lead to breakages at the pre-cut points is prevented. According to one embodiment, the device for operating and controlling this winding drum constitutes a reference for the second winding drum and for the means for moving the core. In particular, the second winding drum is electronically connected to the device for operating and controlling the first winding drum so as to permit variations in the peripheral velocity of the second winding drum in order to regulate the consistency or compactness of the roll being wound. This electrical connection also influences the rate of rotation imposed by the pins on the core and the speed of movement of the core along the increasing portion of the working path "P".

The cores are supplied to the pick-up position "L" of the working path "P" by virtue of the intermittent movement of the supply device described above.

The movement of the cores along the working path "P" is achieved by imposing particular timing rules on the device for operating and controlling the cylinder and piston units as well as on the geared motor units acting on the carriages and on the sliding blocks provided in the tables with crossed guides. In particular, a first pair of opposed pins, operated and controlled in reflectively symmetrical and synchronous manner or, in other words, in electrical alignment, is aligned with a core disposed in the pick-up position "L" and is moved towards the core so as to insert the pins in its opposed tubular ends until the annular projection of each pin is brought into abutment with the edge of the core. The geared motor units, acting by means of the racks on the carriages, extract the core from the loader with flat springs by a movement along the approach portion of the working path "P". Once the core has been picked up, the motors for rotating the pins are operated so as to bring the peripheral velocity of the core substantially to the peripheral velocity of the winding drum and of the web material guided thereby, facilitating the initial gripping of an edge of the web material by the core which has been brought to the pick-up position "F" between the two winding drums. When the edge has been gripped by the core, the web material, guided by the winding drum, is wound onto the core, which is rotated in controlled manner, to form a roll. During this stage of the winding of the roll, the core is moved away from the gripping position "F", that is, the diametral point, or the point at which the gap between the winding drums is smallest, travelling along the increasing portion of the working path. During the enlargement or increase of the roll, the rate of rotation of the core is reduced so that the peripheral velocity of the roll being formed substantially corresponds to the peripheral velocity of the winding drum, or differs by a predefined velocity value, in order to control the compactness or consistency of the roll being formed. The timing rules by which the rate of rotation of the core is reduced are also set in dependence on the calculated movement of the core in the increasing portion of the working path "P" as well as on the thickness of the web material. During the size enlargement or increasing, the core is advantageously moved away from the pick-up position so that the roll is kept continuously bearing against the winding drums. Upon completion of the winding, the roll is separated from the web material guided by the winding drum, for example, by tearing in the region of a pre-cut line previously made in the web material. This tearing advantageously takes place without the use of further devices for cutting or stopping the web material. In particular, upon completion of the formation of the roll, an abrupt movement of the core away from the final winding position "B" and, together therewith or separately, an abrupt acceleration of the rotation of the core, are imparted to tear the web material. When the tearing has taken place, the pins are extracted from the ends of the core in the release position "U", by an axial movement of the pins, leaving the roll free to fall by gravity onto the discharge chute. The pins then return to the pick-up position, still with a synchronized and reflectively symmetrical movement, to perform a new cycle (FIGS. 4*a*, 4*b*, 5 and 6).

By virtue of the fact that it is possible to bring about out-of-phase rotation of the two opposed pins engaged in the ends of a core, it is possible to control and to regulate the twisting of the core during the winding and particularly at the beginning of the winding when undesired flexural and/or torsional oscillations arise in the roll being formed.

During the stage of the enlargement of the roll of web material wound on the core, the core is subjected to an axial pulling action which is facilitated by the provision of springs having arms with blade-like ends for grasping the end portion of the core. This pulling action brings about a stiffening of the core and hence an adequate support for the web material being wound and also opposes bending due to a long length or axial extent of the core, which would favour the establishment of vibrations during the winding stage.

Whilst one pair of opposed pins is performing the winding, the second pair of pins prepares for the movement of a subsequent core. This second pair performs the above-described winding cycle before the previous core inside the roll is released, so that the edge of web. material released by the tearing brought about by the movement of the previous core is picked up on this subsequent core. Whilst a first pair of pins expels its roll, the other pair of pins performs the winding of a subsequent roll, permitting a continuous cycle without dead times.

It can be appreciated from the foregoing that the proposed rewinding machine permits the use of long cores. The fact that the roll being formed is arranged to bear constantly on at least one winding drum prevents undesired bending which arises in known central winding machines.

An advantage is that it is possible to achieve the desired consistency of the roll by virtue of the synergy provided between the forward movements, the controlled rotation, and the support of the roll being formed on at least one winding drum. In particular, with the proposed rewinding machine, it is possible to wind the web material onto the core with a predetermined and uniform consistency throughout the thickness of the roll.

As well as supporting the core during winding, the provision of opposed motor-driven pins enables the rotation of the core to be imparted directly in order to achieve accurate control of the winding and to affect directly the compactness of the web material rolled, as well as preventing both flexural and torsional vibrations produced in the roll.

By differentiating the speeds of rotation of the ends of the core, it is possible to affect the oscillation of the roll being formed.

Each end of the core can be moved independently of the other, enabling the parallelism of the axis of the roll relative to the axes of the drums to be regulated and enabling the formation of the roll to be controlled, that is, preventing rolling deformities between one end of the roll and the other.

The ability to exert an axial pull on the core enables the core to be stiffened, further reducing its bending and the winding deformity of the web material.

The rewinding machine proposed avoids the need to use separate and complex means for cutting with blades or tearing by stopping, and enables the roll wound to be separated from the web material simply by accelerating the rotation of the core and/or abruptly accelerating the onward movement of the roll, achieving structural simplicity and more reliable operation of the machine.

The provision of two pairs of opposed pins enables continuity of production of the rolls to be achieved, avoiding abrupt slowing-down and acceleration of the web material.

By virtue of the preliminary rotation of the core along the approach portion of the working path, the contact between the core and the web material is gentle. This prevents undesired breakage of the web material during the first stages of the winding and, above all, prevents the first coils of material wound on the core from being stretched, avoiding an appearance of poor quality being imparted to the roll.

Clearly, variants and/or additions may be provided for the embodiment described and illustrated above.

Figure 3C:
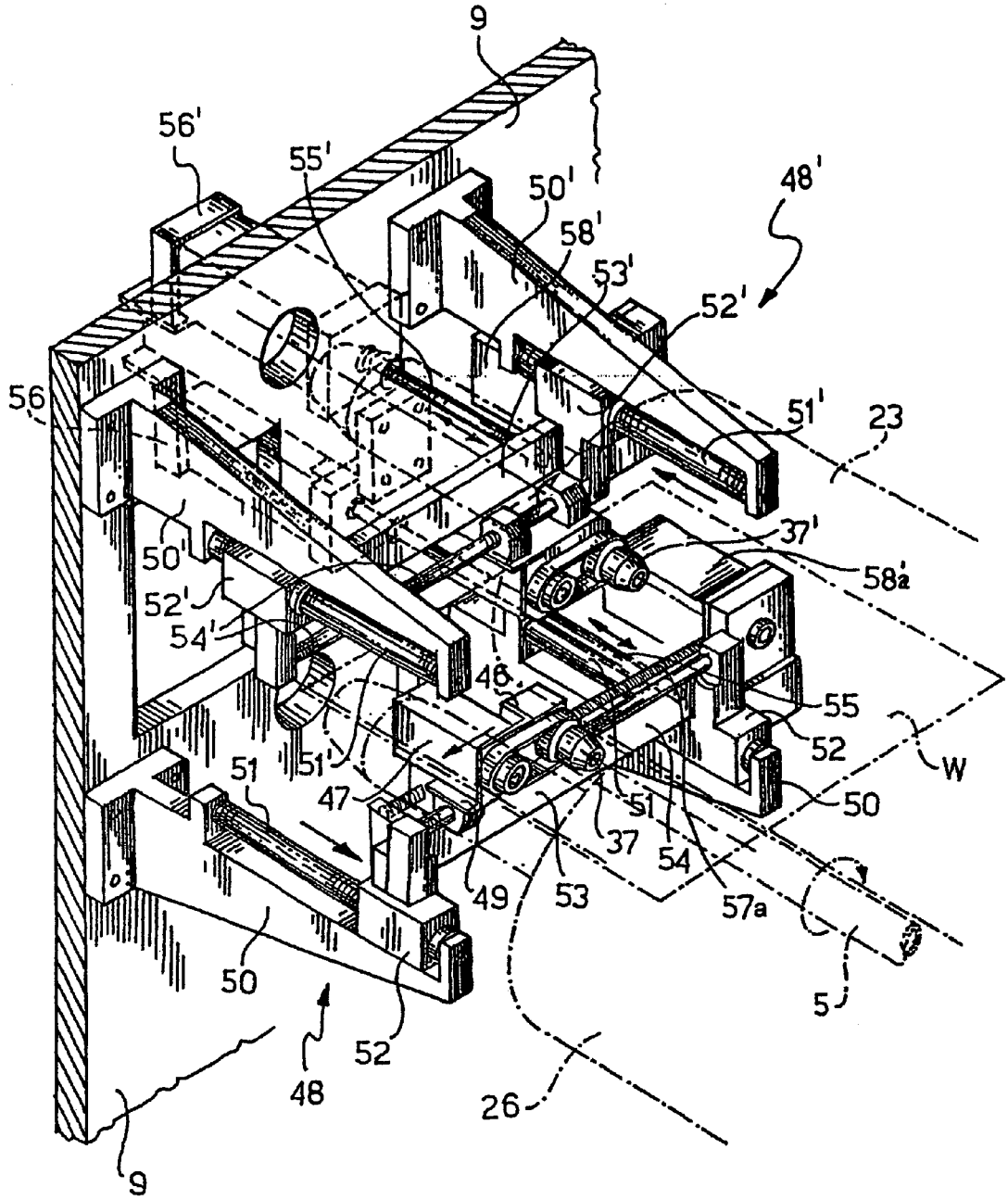
Figure 4A:
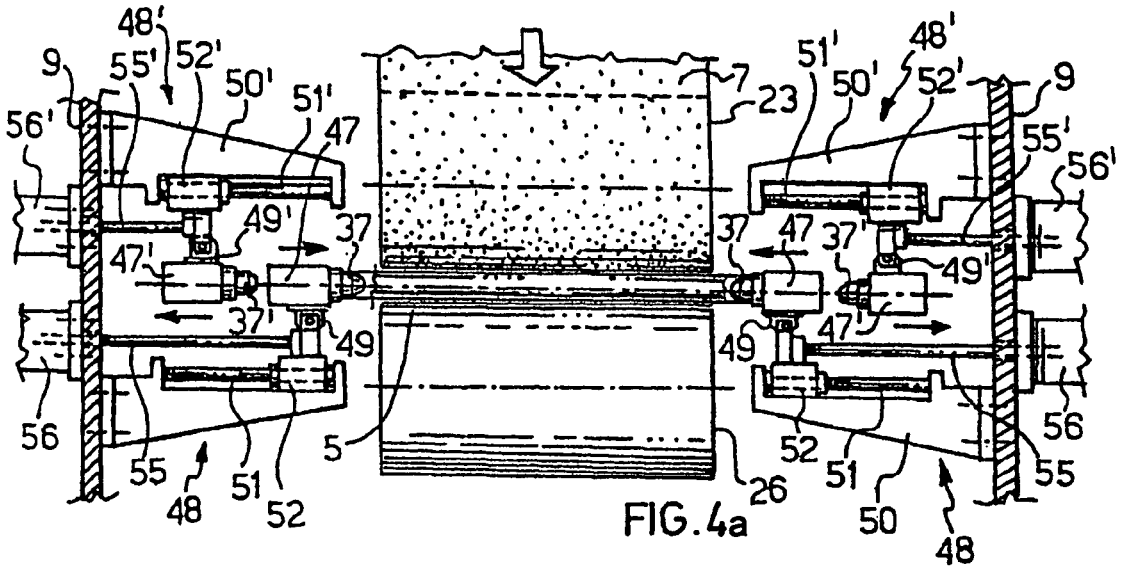
FIG. 4*a* is a partially-sectioned view, taken on the arrow IV of FIG. 1, of another detail of the rewinding machine.
Figure 4B:
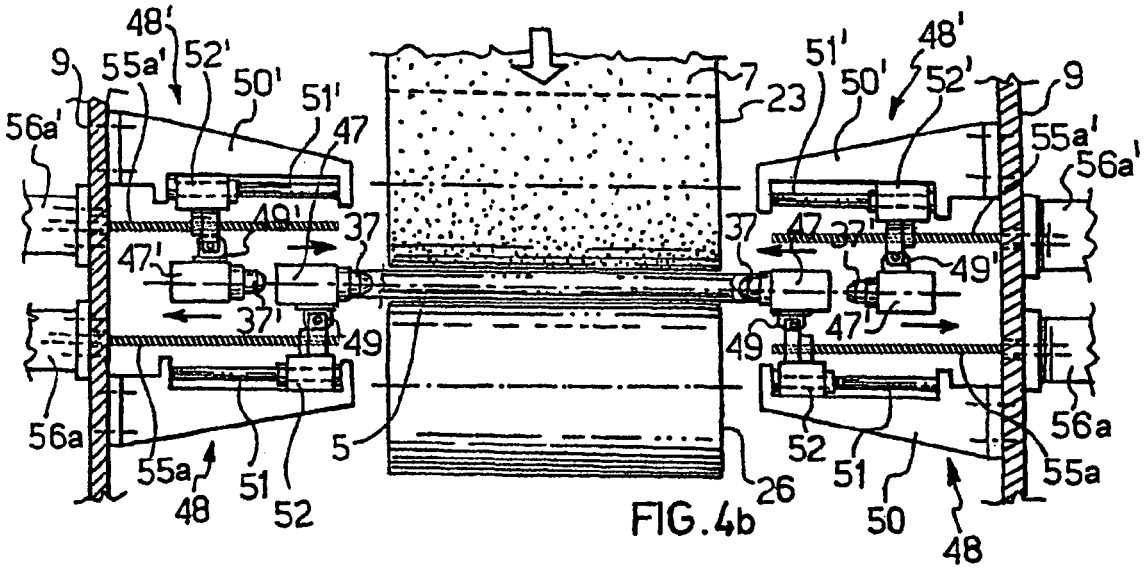
FIG. 4*b* is a partially-sectioned of the rewinding machine according to an embodiment of the present invention.
Figure 5:
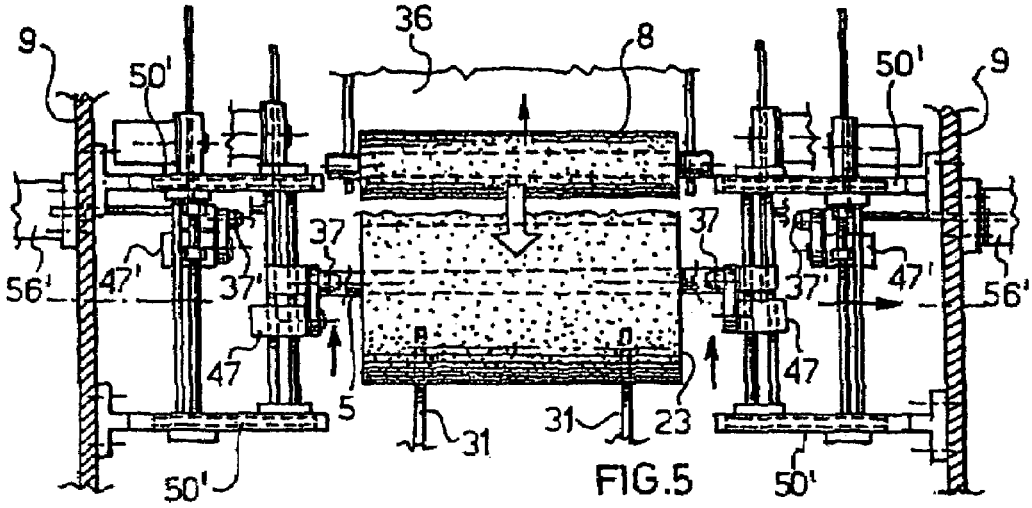
FIG. 5 shows the detail of FIG. 4*a*, from above, in a first operating stage.
Figure 6:
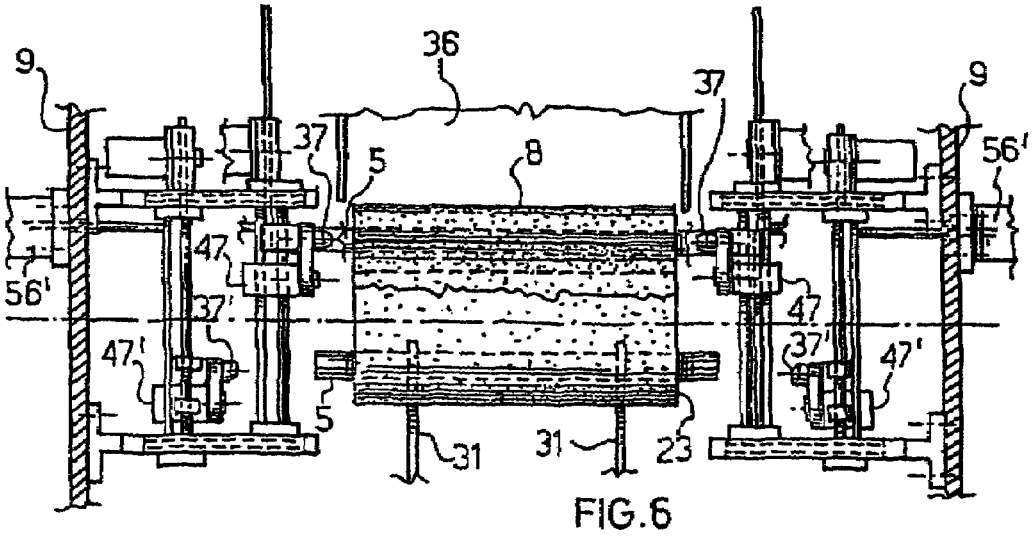
FIG. 6 shows the detail of FIG. 4*a*, from above, in a second operating stage.
Figure 7:
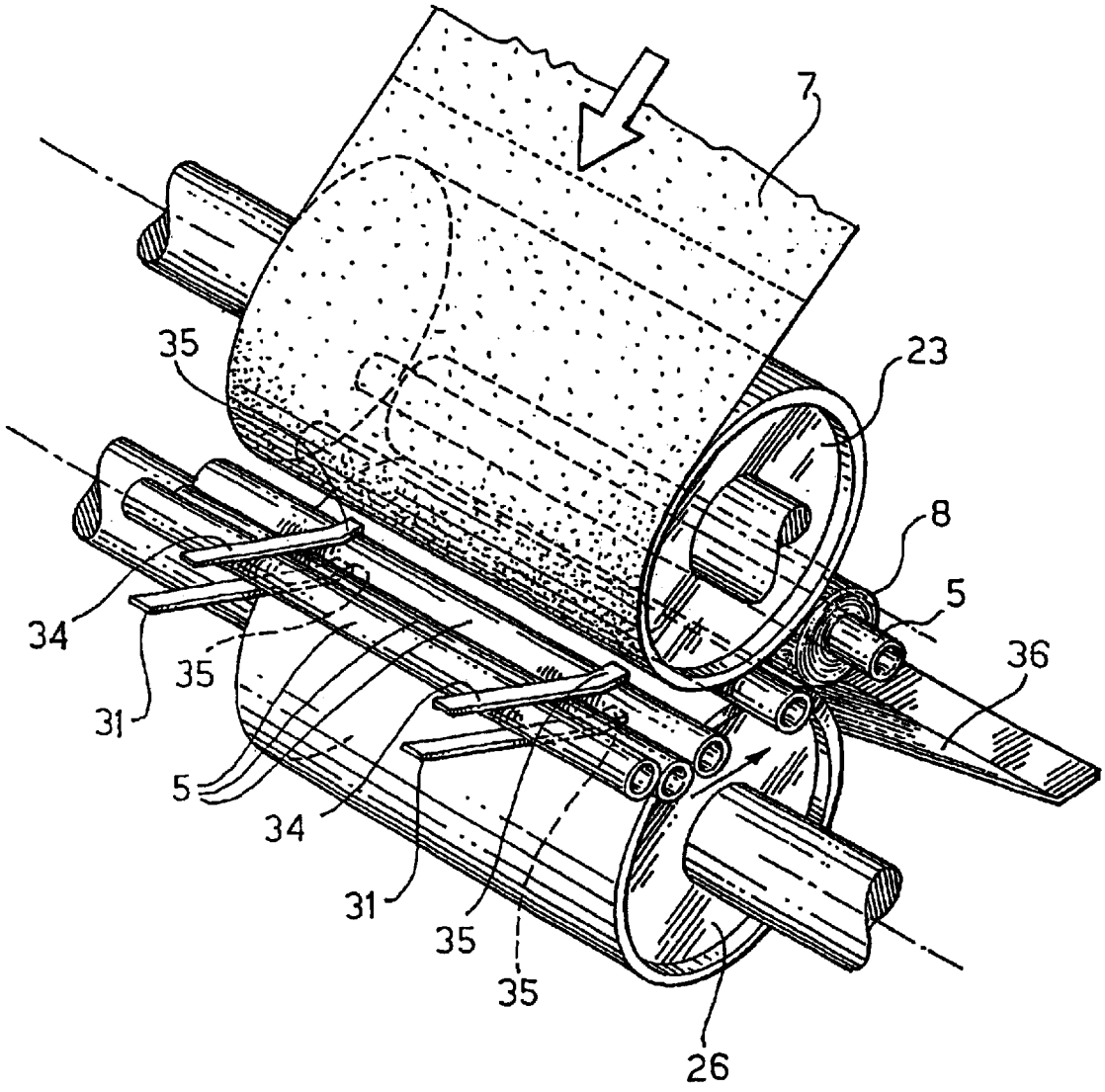
FIG. 7 is a partially-sectioned axonometric view of yet another detail of the rewinding macine of FIG. 1.

As an alternative to the embodiment shown in the drawings, instead of using cylinder and piston units as well as racks and pinions for moving the pins towards and away from the core and along the working path, recirculating ball screws 55*a* and 55*a*' of FIG. 4*b*, and 57*a* of FIG. 3*c*operatively connected to electric motors 56*a* and 56*a*' of FIG. 4*b*, and 58*a* and 58*a*' of FIG. 3*c* or, preferably, linear electric motors may be used.

As an alternative to the embodiment described above, the pins may be keyed directly to a shaft of an electric motor or, in other words, direct drive of the pins, or motor-driven pins, may be provided.

The device for the support, controlled rotation, and movement of the cores (the table with crossed guides) may advantageously be formed independently of the provision of continuous support for the roll being wound on at least one drum so as to operate in accordance with a central winding method.

As an alternative to the embodiment described above, it is possible to provide a core constituted by two half-cores which can be connected to one another and can be removed from the material wound thereon, to form rolls without cores.

It is advantageously possible to provide a control of the movement of the core along the working path "P" with feedback by a signal proportional to the thickness of the web material in order to constitute a further control of the consistency of the roll being formed.

In order to satisfy contingent and specific requirements, a person skilled in the art may apply to the above-described preferred embodiment of the rewinding machine many modifications, adaptations and replacements of elements with other functionally equivalent elements without, however, departing from the scope of the appended claims.

What is claimed is:

1. A rewinding machine for winding web material onto a core to form rolls, comprising:

supply means for supplying the web material at a predefined supply speed;

a first winding drum rotating with a peripheral velocity substantially corresponding to the supply speed and having a guide for the web material;

means for gripping the ends of the core during winding;

means for moving the core along a path in which the roll of web material wound on the core is increased;

means for rotating the core in order to wind the web material onto the core to form a roll;

a second winding drum located in opposition to the first winding drum, the path extending through a space defined between the first and second winding drums;

means for influencing the roll to bear against and remain in contact with the two winding drums as the core moves along the path extending through a space defined between the first winding drum and the second winding drum; and means for pulling the core axially during winding of the web material, said means for pulling the core axially comprising opposed carriages facing the ends of the core and slidable on guides arranged transverse to the working path;

wherein said means for gripping comprises a pin and said means for rotating the core comprises a motor for rotating the pin such that said means for gripping directly imparts a rotation to the core, said means for rotating the core being controllable to achieve a peripheral velocity of the roll being formed substantially corresponding to, less than, or greater than the supply speed of the web material.

2. A rewinding machine according to claim 1, comprising a supply device for arranging the core in a pick-up position of said working path.

3. A rewinding machine according to claim 1 comprising means for releasing the core in a position for the release of a wound roll.

4. A rewinding machine according to claim 1 in which the first winding drum is controllable to have a peripheral velocity substantially corresponding to, greater than, or less than the supply speed of the web material.

5. A rewinding machine according to claim 1, in which the distance between the second winding drum and the first winding drum substantially corresponds to a transverse size of the core.

6. A rewinding machine according to claim 1, in which said working path starts from a pick up position of the core and terminates in a release position of the roll and extends through said position of initial contact of the core with the web material guided on the first winding drum and through said subsequent final winding position, wherein the means for gripping comprise a pair of opposed pins associated with the ends of the core in any position thereof on the working path.

7. A rewinding machine according to claim 1, in which the second winding drum is controllable to have a peripheral velocity substantially corresponding to, greater than, or less than the supply speed of the web material.

8. A rewinding machine according to claim 1 in which the core is a tubular core.

9. A rewinding machine according to claim 8 in which the means for gripping the core comprise opposed pins which can be operatively associated with the insides of the ends of the tubular core.

10. A rewinding machine according to claim 9 in which each of the pins comprises a frustoconical insertion end.

11. A rewinding machine according to claim 9 in which each of the pins comprises retaining means in engagement with the internal surface of the wall of the tubular core.

12. A rewinding machine according to claim 11 in which the retaining means comprise at least one resilient expansion device housed in at least one longitudinal channel provided in the pin, the expansion device comprising at least one bladed element acting to oppose slipping-out of the pin.

13. A rewinding machine according to claim 1 in which the means for gripping are operatively associated with the means for rotating the core.

14. A rewinding machine according to claim 1 in which the means for rotating the core comprise an electric motor.

15. A rewinding machine according to claim 14 in which the electric motor is operatively connected to a control device.

16. A rewinding machine according to claim 15 in which the control device is operatively connected to a device that controls the supply means.

17. A rewinding machine according to claim 1 in which a detection device is interposed between the means for gripping and the means for rotating the core, the detection device detects the force transmitted between the means for gripping and the means for rotating and is operatively connected to a control device controlling the operation of the means for rotating the core.

18. A rewinding machine according to claim 1 in which the means for rotating the core comprises independent means for rotating each end of the core.

19. A rewinding machine according to claim 18 in which the independent means for rotating the core are operatively connected to a control device for their synchronized or out-of-phase operation.

20. A rewinding machine according to claim 1 in which each of the opposed carriages is operatively connected to an actuation device.

21. A rewinding machine according to claim 20 in which the actuation device of each carriage comprises a hydraulic or pneumatic cylinder and piston unit or a linear electric motor and is controlled by a control device.

22. A rewinding machine according to claim 20 in which the actuation device of each carriage comprises a rack and pinion unit operatively connected to a motor and is controlled by a control device.

23. A rewinding machine according to claim 20 in which the actuation device of each carriage comprises a recirculating ball screw unit operatively connected to a motor and is controlled by a control device.

24. A rewinding machine according to claim 1 in which the means for gripping the core are operatively connected to the means for moving the core.

25. A rewinding machine according to claim 24 in which the moving means comprise carriages arranged facing one another in the vicinity of the ends of the core, the carriages being movable along movement axes arranged parallel to and perpendicular to the working path.

26. A rewinding machine according to claim 25 in which each of the carriages is moved along the axes by at least one actuating device.

27. A rewinding machine according to claim 26 in which the at least one actuating device of each carriage comprises at least one hydraulic or pneumatic cylinder and piston unit.

28. A rewinding machine according to claim 26 in which each carriage is moved along at least one of the movement axes and controlled by a control device.

29. A rewinding machine according to claim 1 further comprising independent means for moving each end of the core.

30. A rewinding machine according to claim 29 in which each of the independent means for moving the core is operatively connected to a control device for synchronized or out-of-phase operation of each of the independent means for moving the core.

31. A rewinding machine claim 1 in which the means for gripping further comprises twin independent gripping means associated with ends of cores on the same side or side wall of the rewinding machine.

32. A rewinding machine according to claim 1 in which the means for rotating further comprises twin independent means for rotating associated with ends of cores on a same side or a same side wall of the rewinding machine.

33. A rewinding machine according to claim 1 in which twin independent means are provided for moving the core and can be associated with ends of cores on a same side or a same side wall of the rewinding machine.

34. A rewinding machine according to claim 1 in which the means for influencing the roll further comprises twin independent means for influencing rolls to bear on the winding drum are provided for each side of the rewinding machine.

35. A rewinding machine according to claim 1 in which the supply means comprise a drum for pulling the web material, operatively connected to a motor.

36. A rewinding machine according to claim 35 in which the motor is operatively connected to a control device for operation of the pulling drum in synchronism or out of phase with the winding drum and with the means for gripping and with the means for moving, rotating and influencing the roll bearing on the winding drum.

37. A rewinding machine according to claim 35 in which a device is provided between the pulling drum and the motor, the device detects a force transmitted between the pulling drum and the motor, and the device is operatively connected to a second device that controls the motor.

38. A rewinding machine according to claim 1 further comprising a means for detecting the thickness of the web material.

39. A rewinding machine according to claim 1 in which the means for detecting the thickness of the web material are operatively connected to the device for controlling the movement of the core for winding of the web material thereon.

40. A rewinding machine according to claim 1 in which the supply device comprises a chute for transporting the core towards restraining means disposed in the vicinity of the winding drum, defining the pick-up position.

41. A rewinding machine according to claim 1 in which the means for influencing the roll bearing against the winding drum comprise at least one resilient device.

42. A rewinding machine according to claim 41 in which the means for influencing the roll bearing on the winding drum comprises a device selected from the group consisting of a spring and a pneumatic device.

43. A rewinding machine according to claim 1, wherein said working path is straight.

44. A method of winding web material on a core to form rolls, comprising:

supplying the web material at a predefined supply speed;

guiding the web material in a winding region defined by the space between oppositely arranged first and second winding drums, the web material being guided through the winding region at a speed substantially corresponding to the supply speed;

engaging each of the ends of the core during winding by a means for gripping;

imparting a rate of rotation directly on the core by said means for gripping;

rotating the core to wind a roll of web material in a manner such as to have a predefined peripheral velocity;

moving the core along a path in which the roll of web material wound on the core is increased, the path extending through the space defined between the first and second winding drums; and influencing the roll in a manner such that the material is wound onto the core while the roll being formed is kept bearing against and in contact with the two winding drums as the core moves along the path;

separating web material already wound on the core from the material being supplied by performing a separation step selected from the group consisting of accelerating rotation of the core, moving the core abruptly away from the winding drum, and combinations thereof; and after said separating, releasing the roll being formed when the roll is fully wound and in a release position of the working path;

wherein said rotating of the core imparted by said means for gripping is controlled to achieve a peripheral velocity of the roll being formed substantially corresponding to, less than, or greater than the supply speed of the web material.

45. A method of winding web material according to claim 44 in which the separation step includes tearing of the web material.

46. A method of winding web material according to claim 44, in which the forward movement of the core along the increasing portion of the working path is controlled in order to influence the roll being formed by bearing on the winding drum.

47. A method of winding web material according to claim 44 in which the core is disposed in a pick-up position from which it is picked up and moved along the working path.

48. A method of winding web material according to claim 47 in which the core is picked up from the pick-up position by being supported at its ends.

49. A method of winding web material according to claim 44 in which the ends of the core are rotated independently of one another and in a synchronized or out-of-phase manner.

50. A method of winding web material according to claim 44 in which torsional vibrations of the core are compensated by rotation of its ends in a controlled and independent manner with differentiation of rates of rotation of the ends.

51. A method of winding web material according to claim 44 in which the core is subjected to an axial pulling force during the winding of the web material.

52. A method of winding web material according to claim 44 in which the ends of the core are moved along the working path independently of one another and in a synchronized or out-of-phase manner.

53. A method of winding web material according to claim 44 in which non-uniformity of winding of the web material on the core is compensated by moving its ends along the working path independently.

54. A method of winding web material according to claim 44 in which the core is rotated before it comes into contact with the web material so that its peripheral velocity is substantially equal to the supply speed of the web material to be picked up in order to be wound around the core.

55. A method of winding web material according to claim 44 in which a rate of rotation of the core is reduced during the winding of the web material onto the core so as to maintain the predefined peripheral velocity throughout the winding.

56. A method of winding web material according to claim 44 in which the force transmitted to the web material in order to supply it at a predefined speed is detected.

57. A method of winding web material according to claim 44 in which the thickness of the web material is detected.

58. A method of winding web material according to claim 57 in which the one of the movement of the core along the increasing path, the rotation of the core, or both, is controlled on the basis of operative parameters including the thickness detected.

59. A method of winding web material according to claim 44, wherein said working path is straight.

60. A rewinding machine for winding web material onto a core to form rolls, comprising:

supply means for supplying the web material at a predefined supply speed;

a first winding drum rotating with a peripheral velocity substantially corresponding to the supply speed and having a guide for the web material;

means for gripping the ends of the core during winding, said means for gripping comprising a pin;

means for moving the core along a path in which the roll of web material wound on the core is increased;

means for rotating the core in order to wind the web material onto the core to form a roll, said means for rotating the core comprising a motor for rotating the pin such that said means for gripping directly imparts a rotation to the core, and said means for rotating the core being controllable to achieve a peripheral velocity of the roll being formed substantially corresponding to, less than, or greater than the supply speed of the web material;

a second winding drum located in opposition to the first winding drum, the path extending through a space defined between the first and second winding drums; and means for influencing the roll to bear against and remain in contact with the two winding drums as the core moves along the path extending through a space defined between the first winding drum and the second winding drum;

wherein said means for gripping the core is operatively connected to the means for moving the core, said means for moving comprising carriages arranged facing one another in the vicinity of the ends of the core, the carriages being movable along movement axes arranged parallel to and perpendicular to the working path, and each of the carriages being moved along the axes by at least one actuating device, said actuating device comprising at least one rack and pinion unit operatively connected to a motor.

61. A rewinding machine for winding web material onto a core to form rolls, comprising:

supply means for supplying the web material at a predefined supply speed;

a first winding drum rotating with a peripheral velocity substantially corresponding to the supply speed and having a guide for the web material;

means for gripping the ends of the core during winding, said means for gripping comprising a pin;

means for moving the core along a path in which the roll of web material wound on the core is increased;

means for rotating the core in order to wind the web material onto the core to form a roll, said means for rotating the core comprising a motor for rotating the pin such that said means for gripping directly imparts a rotation to the core, and said means for rotating the core being controllable to achieve a peripheral velocity of the roll being formed substantially corresponding to, less than, or greater than the supply speed of the web material;

a second winding drum located in opposition to the first winding drum, the path extending through a space defined between the first and second winding drums; and means for influencing the roll to bear against and remain in contact with the two winding drums as the core moves along the path extending through a space defined between the first winding drum and the second winding drum;

wherein said means for gripping the core is operatively connected to the means for moving the core, said means for moving comprising carriages arranged facing one another in the vicinity of the ends of the core, the carriages being movable along movement axes arranged parallel to and perpendicular to the working path, and each of the carriages being moved along the axes by at least one actuating device comprising at least one recirculating ball screw unit operatively connected to a motor.

* * * * *